US009660423B2

(12) United States Patent
Ozeki

(10) Patent No.: US 9,660,423 B2
(45) Date of Patent: May 23, 2017

(54) SPARK PLUG HAVING AN ELECTRODE STRUCTURE THAT EFFECTIVELY SUPPRESSES FLASHOVER

(71) Applicant: NGK SPARK PLUG CO., LTD., Nagoya-shi, Aichi (JP)

(72) Inventor: Keiji Ozeki, Konan (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/109,712

(22) PCT Filed: Jan. 13, 2015

(86) PCT No.: PCT/JP2015/000098

§ 371 (c)(1),
(2) Date: Jul. 5, 2016

(87) PCT Pub. No.: WO2015/111381

PCT Pub. Date: Jul. 30, 2015

(65) Prior Publication Data

US 2016/0329688 A1 Nov. 10, 2016

(30) Foreign Application Priority Data

Jan. 24, 2014 (JP) ..... 2014-011376

(51) Int. Cl.
*H01T 13/20* (2006.01)
*H01T 13/04* (2006.01)
*H01T 13/34* (2006.01)

(52) U.S. Cl.
CPC ..... *H01T 13/20* (2013.01); *H01T 13/04* (2013.01); *H01T 13/34* (2013.01)

(58) Field of Classification Search
CPC ..... H01T 13/20; H01T 13/04; H01T 13/34
See application file for complete search history.

(56) References Cited

U.S. PATENT DOCUMENTS

2006/0042610 A1 3/2006 Abe et al.
2014/0346945 A1 11/2014 Nakamura

FOREIGN PATENT DOCUMENTS

| | | | | |
|---|---|---|---|---|
| JP | 2003-045609 A | 2/2003 | ..... | H01T 13/20 |
| JP | 2006-100250 A | 4/2006 | ..... | F03P 13/00 |
| JP | 2013-016295 A | 1/2013 | ..... | H01T 13/20 |
| JP | 2013-131375 A | 7/2013 | ..... | F02P 13/00 |
| WO | WO 2013/094139 A1 | 6/2013 | ..... | H01T 13/20 |

OTHER PUBLICATIONS

Nakamura,Japanese PCT WO2013-094139. Jun. 2013, machine translation.*
Search Report issued in International Patent Application No. PCT/JP2015/000098, dated Mar. 24, 2015.
Written Opinion of the International Searching Authority for International Patent Application No. PCT/JP2015/000098, dated Mar. 24, 2015.

* cited by examiner

*Primary Examiner* — Tracie Y Green
(74) *Attorney, Agent, or Firm* — Kusner & Jaffe

(57) ABSTRACT

It is an object to reduce eccentricity between a terminal nut and an insulator. A spark plug includes an insulator, a terminal nut, and a metallic shell. The outside diameter of the insulator at a rear end of the metallic shell is smaller than or equal to 8 mm, and the contact area between a flat portion of the insulator and a contact surface of the terminal nut is smaller than 10 mm$^2$.

6 Claims, 6 Drawing Sheets

SAMPLE S03

SAMPLE C01

SAMPLE C02

| SAMPLE No. | DIMENSIONS | | | | EXPERIMENTAL RESULTS | |
|---|---|---|---|---|---|---|
| | INSULATOR OUTSIDE DIAMETER D18 (mm) | CONTACT SURFACE 42 OUTSIDE DIAMETER Do (mm) | FLAT PORTION 11 INSIDE DIAMETER Di (mm) | CONTACT AREA Rc ($mm^2$) | TERMINAL NUT ECCENTRICITY (mm) | PRESENCE/ ABSENCE OF INSULATOR CRACK |
| C01 (FIG. 4) | 9.0 | 7.1 | 5.8 | 13.17 | 0.456 | ○ |
| C02 (FIG. 5) | 7.5 | 6.1 | 4.9 | 10.37 | 0.440 | ○ |
| S01 | 7.5 | 5.7 | 4.9 | 6.66 | 0.407 | ○ |
| S02 | 7.5 | 5.5 | 4.9 | 4.90 | 0.397 | ○ |
| S03 (FIG. 3) | 7.5 | 5.4 | 4.9 | 4.04 | 0.396 | ○ |
| S04 | 7.5 | 5.3 | 4.9 | 3.20 | 0.384 | ○ |
| S05 | 7.5 | 5.2 | 4.9 | 2.38 | 0.384 | ○ |
| S06 | 7.5 | 5.1 | 4.9 | 1.57 | 0.382 | △ |
| S07 | 7.5 | 5.0 | 4.9 | 0.78 | 0.379 | △ |

SPARK PLUG HAVING AN ELECTRODE STRUCTURE THAT EFFECTIVELY SUPPRESSES FLASHOVER

RELATED APPLICATIONS

This application is a National Stage of International Application No. PCT/JP2015/000098 filed Jan. 13, 2015 ,which claims the benefit of Japanese Patent Application No. 2014-011376, filed Jan. 24, 2014.

FIELD OF THE INVENTION

The present invention relates to a spark plug.

BACKGROUND OF THE INVENTION

In general, spark plugs have a center electrode and a ground electrode in a front end portion thereof and a terminal nut, for receiving supply of electric power, in a rear end portion thereof. The terminal nut is held in an axial hole of an insulator and protrudes from a rear end of the insulator. The insulator is accommodated and held in a metallic shell. A flat portion is formed at the rear end of the insulator, and a contact surface of a stepped portion of the terminal nut is in contact with the flat portion of the insulator.

The terminal nut is fixed to the inside of the axial hole of the insulator by a heat sealing process. In the heat sealing process, in a state in which a front end portion of the insulator is oriented downward, first, a center electrode is inserted into a front end portion of the axial hole of the insulator. Resistor powder and electroconductive sealing powder are then put into the axial hole. Subsequently, the terminal nut is inserted into the axial hole in such a way that the terminal nut protrudes from the rear end of the insulator. Next, while pressing the terminal nut downward, the resistor powder and the electroconductive sealing powder are heated to be softened and then cooled to be solidified, and thereby the center electrode and the terminal nut are sealed and fixed to each other in the axial hole of the insulator. The insulator, in which the center electrode and the terminal nut have been fixed to each other in this way, is fixed to the metallic shell by a crimping process. In the crimping process, a crimping portion at the rear end of the metallic shell is crimped, and a buckling portion of the metallic shell is buckled. As a result, the metallic shell and the insulator engage each other securely. In the crimping process, in order to hold the insulator at a correct position, crimping is performed while pressing the terminal nut at the rear end by using a pressing jig.

Regarding spark plugs, various technologies have been developed in order to suppress flashover (surface creepage that occurs between the terminal nut and the metallic shell along the surface of the insulator) and to prevent breakage of the insulator (See Japanese Unexamined Patent Application Publication No. 2003-45609; Japanese Unexamined Patent Application Publication No. 2013-16295; and Japanese Unexamined Patent Application Publication No. 2013-131375).

In recent years, spark plugs have been reduced in size and diameter for the purpose of increasing flexibility in the design of internal combustion engines. As the diameter of a spark plug is reduced, the thickness of the insulator is reduced, and therefore a problem arises in that the strength of the insulator is reduced. Moreover, various parts of the spark plug are required to have a higher dimensional accuracy and a higher assembly accuracy. Regarding the assembly accuracy of the spark plug, the eccentricity between the terminal nut and the insulator after the aforementioned heat sealing process is particularly important. That is, when the eccentricity between the terminal nut and the insulator increases, it is likely that required assembly accuracy cannot be satisfied in the aforementioned crimping process. To be more specific, if the eccentricity between the terminal nut and the insulator is large, the terminal nut (and the insulator) cannot be held at a correct position in the crimping process, and the insulator may be fixed to the metallic shell in a state in which the insulator is considerably displaced.

There is also a problem in that flashover becomes more likely to occur as the eccentricity between the terminal nut and the insulator increases. That is, a flat portion, which comes into contact with a contact surface of a stepped portion of the terminal nut, is formed at an insulator head (the rear end of the insulator). The flat portion of the insulator head, which has an outside diameter larger than that of the terminal nut, has a function of suppressing flashover. However, if the eccentricity between the terminal nut and the insulator is large, the assembled shape is equivalent to a shape in which the outside diameter of the flat portion of the insulator head is effectively small, so that a problem arises in that flashover becomes more likely to occur.

The present invention, which has been devised to address the aforementioned problem, can be implemented as follows.

SUMMARY OF THE INVENTION (1) According to a first aspect of the present invention, there is provided a spark plug including an insulator including an axial hole extending in an axial direction and a flat portion located at a rear end; a terminal nut disposed at a rear end of the axial hole and having a contact surface that is in contact with the flat portion; and a tubular metallic shell holding the insulator therein. In the spark plug, an outside diameter of the insulator at a rear end of the metallic shell is smaller than or equal to 8 mm, and a contact area between the flat portion of the insulator and the contact surface of the terminal nut is smaller than 10 $mm^2$.

With the spark plug, it is possible to reduce the eccentricity between the terminal nut and the insulator, because the contact area between the flat portion of the insulator and the contact surface of the terminal nut is smaller than 10 $mm^2$. In particular, in the case where the outside diameter of the insulator at the rear end of the metallic shell is smaller than or equal to 8 mm, the eccentricity between the terminal nut and the insulator has a considerable effect on the assembly accuracy and the performance of the spark plug (such as flashover), and therefore a significant advantage can be obtained by reducing the eccentricity between the terminal nut and the insulator.

(2) In accordance with a second aspect of the present invention, there is provided a spark plug as described above, wherein the contact area may be smaller than 8 $mm^2$.

With this structure, the eccentricity between the terminal nut and the insulator can be further reduced.

(3) In accordance with a third aspect of the present invention, there is provided a spark plug as described above, wherein the contact area may be smaller than 5 $mm^2$.

With this structure, the eccentricity between the terminal nut and the insulator can be further reduced.

(4) In accordance with a fourth aspect of the present invention, there is provided a spark plug as described above, wherein the contact area may be larger than or equal to 2.3 $mm^2$.

With this structure, when fixing the terminal nut in the axial hole of the insulator by a heat sealing process, the probability of breakage of the head of the insulator can be reduced.

(5) In accordance with a fifth aspect of the present invention, there is provided a spark plug as described above, wherein the terminal nut may include a projecting portion that is adjacent to a rear end of the contact surface and in which an outside diameter of the terminal nut gradually increases toward a rear side in the axial direction and then gradually decreases, and a difference between a maximum outside diameter of the projecting portion and the outside diameter of the terminal nut at a rear end of the projecting portion may be smaller than or equal to 0.2 mm.

With this structure, it is possible to suppress occurrence of flashover, because the flashover start voltage can be increased.

(6) In accordance with a sixth aspect of the present invention, there is provided a spark plug as described above, wherein a distance t, measured in the axial direction, from the flat portion of the insulator to a position of the maximum outside diameter of the projecting portion of the terminal nut and a width T of the projecting portion in the axial direction may have a relationship $t>T/2$.

With this structure, it is possible to further suppress occurrence of flashover, because the flashover start voltage can be further increased.

(7) In accordance with a seventh aspect of the present invention, there is provided a spark plug as described above, wherein an outer shape of the insulator on a rear side of the rear end of the metallic shell may include a columnar portion and a rear-end tapered portion, the columnar portion being adjacent to the rear end of the metallic shell and having a uniform outside diameter, the rear-end tapered portion being adjacent to a rear end of the columnar portion and having an outside diameter that gradually decreases to the flat portion.

With this structure, although flashover tends to occur because the insulator does not have corrugations, it is possible to reduce the eccentricity between the terminal nut and the insulator and to suppress occurrence of flashover because the structure has the feature described above.

The present invention can be implemented in various embodiments. For example, the present invention can be implemented in embodiments of a spark plug and a method of manufacturing a spark plug.

DETAILED DESCRIPTION OF THE PREFERRED EMBODIMENTS

Figure 1:
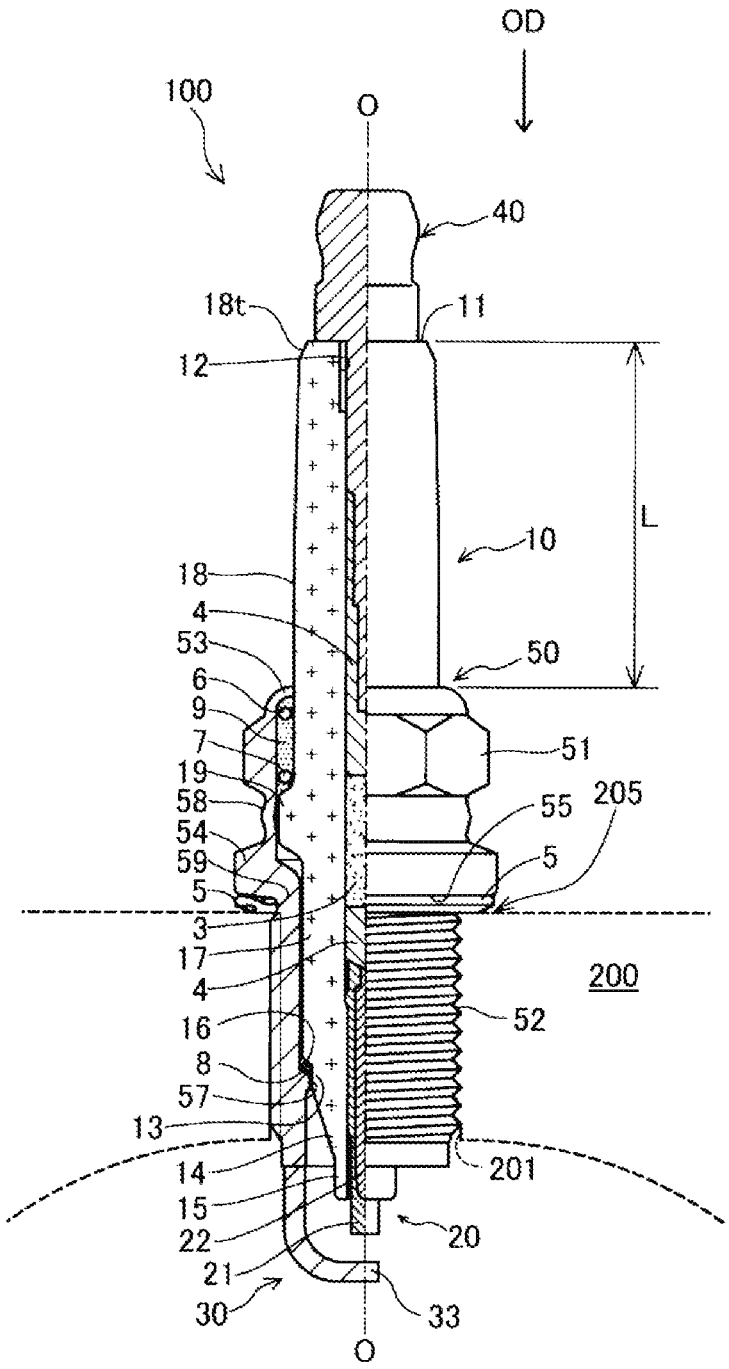
FIG. 1 is a partial sectional view of a spark plug according to an embodiment.

FIG. 1 is a partial sectional view of a spark plug 100 according to an embodiment of the present invention. In the following description, the axial direction OD shown in FIG. 1 is defined as the up-down direction, the lower side in FIG. 1 is defined as the front side of the spark plug, and the upper side in FIG. 1 is defined as the rear side of the spark plug. The spark plug 100 includes an insulator 10, a center electrode 20, a ground electrode 30, a terminal nut 40, and a metallic shell 50. The insulator 10 has an axial hole 12 extending along the axis O. The center electrode 20, which is a bar-shaped electrode extending along the axis O, is inserted into and held in the axial hole 12 of the insulator 10. The metallic shell 50 is a tubular member that surrounds the outer periphery of the insulator 10 and in which the insulator 10 is fixed.

The ground electrode 30 is an electrode one end of which is fixed to the front end of the metallic shell 50 and the other end of which faces the center electrode 20. The terminal nut 40, which is an electrode for receiving supply of electric power, is electrically connected to the center electrode 20. In a state in which the spark plug 100 is attached to an engine head 200, when a high voltage is applied across the terminal nut 40 and the engine head 200, spark discharge occurs between the center electrode 20 and the ground electrode 30.

The insulator 10 is made of a ceramic material (such as alumina). The axial hole 12, which extends in the axial direction OD, is formed in the insulator 10. A flange 19, having the largest outside diameter, is disposed at substantially the center of the insulator 10 in the axial direction OD. A rear body 18 is disposed on the rear side of the flange 19. The rear body 18, which has a substantially uniform outside diameter, may be referred to as a "columnar portion" or an "insulator mark portion." The name "insulator mark portion" comes from the fact that marks, such as characters, are formed on this portion. The rear body 18 includes a rear-end tapered portion 18*t*, having a decreasing outside diameter, in a rearmost portion thereof. A flat portion 11 is formed at the rear end of the insulator 10 adjacent to the rear-end tapered portion 18*t*. The flat portion 11, which is in contact with a contact surface (described below) of the terminal nut 40, is a flat surface perpendicular to the axial direction OD. The insulator 10 of the spark plug 100 does not have corrugations. That is, the outer shape of the insulator 10 on the rear side of the rear end of the metallic shell 50 only includes a portion (the rear body 18, that is, a columnar portion) that is adjacent to the rear end of the metallic shell 50 and that has a uniform outside diameter and a portion (the rear-end tapered portion 18*t*) that is adjacent to the rear end of the rear body 18 and that has an outside diameter that decrease toward the flat portion 11. In other words, the insulator 10 has such a shape that, on the rear side of the rear end of the metallic shell 50, the outside diameter of the insulator 10 monotonically decreases without increasing even temporarily. The reason that the insulator 10 has such a shape is that, with increasing demand for reduction in the diameter of the spark plug 100, if the insulator 10 had corrugations (protrusions and recesses arranged in the axial direction), the thickness of the insulator 10 would become excessively small and the strength of the insulator 10 would be reduced. Corrugations have an effect of suppressing occurrence of flashover. Because flashover is likely to occur on the spark plug 100, which does not have corrugations, countermeasures against flashover (described below) are particularly important.

The exposed length L of the insulator 10 is defined as the length of the insulator 10 in the axial direction OD from the rear end of the metallic shell 50 to the flat portion 11 at the rear end of the insulator 10. If the exposed length L is sufficiently large, flashover is not likely to occur. In contrast, if the exposed length L is small, flashover is likely to occur. For example, if the exposed length L of the insulator 10 is larger than or equal to 28 mm, it is possible to sufficiently suppress occurrence of flashover (see Japanese Unexamined Patent Application Publication No. 2013-131375). On the other hand, if the exposed length L of the insulator 10 is smaller than 28 mm, flashover tends to occur, and therefore countermeasures against flashover (described below) are particularly important.

A front body 17, whose outside diameter is smaller than that of the rear body 18, is disposed on the front side of the flange 19, which is at the center of the insulator 10. A first cylindrical portion 13, a tapered portion 14, and a second cylindrical portion 15 are disposed on the front side of the front body 17. The outside diameter of the tapered portion 14 decreases toward the front end thereof. In the state in which the spark plug 100 is attached to the engine head 200 of an internal combustion engine, the tapered portion 14 and the second cylindrical portion 15 are exposed in the combustion chamber of the internal combustion engine. An outer stepped portion 16 is disposed between the first cylindrical portion 13 and the front body 17.

The center electrode 20 is a bar-shaped member that is disposed in the axial hole 12 of the insulator 10 and that extends from the rear side toward the front side. The front end of the center electrode 20 is exposed from a front end portion of the insulator 10. In the present embodiment, the center electrode 20 has a structure in which a core 22 is embedded in an electrode base member 21.

A sealing member 4 and a ceramic resistor 3 are disposed in a part of the axial hole 12 of the insulator 10 on the rear side of the center electrode 20. The center electrode 20 is electrically connected to the terminal nut 40 through the sealing member 4 and the ceramic resistor 3.

The metallic shell 50, which is a tubular shell made of a low-carbon steel, holds the insulator 10 therein. The metallic shell 50 surrounds a portion of the insulator 10 extending from a part of the rear body 18 to a part of the second cylindrical portion 15.

A tool engagement portion 51 and a threaded portion 52 are formed on the outer periphery of the metallic shell 50. The tool engagement portion 51 is a portion onto which a spark plug wrench (not shown) is to be fitted. The threaded portion 52 of the metallic shell 50, on which threads are formed, is screwed into a screw hole 201 of the engine head 200 of an internal combustion engine. The spark plug 100 is fixed to the engine head 200 of the internal combustion engine by screwing the threaded portion 52 of the metallic shell 50 into the screw hole 201 of the engine head 200.

A flange 54, which protrudes outward in the radial direction and has a flange-like shape, is disposed between the tool engagement portion 51 and the threaded portion 52 of the metallic shell 50. An annular gasket 5 is fitted onto a threaded neck 59 between the threaded portion 52 and the flange 54. When the spark plug 100 is attached to the engine head 200, the gasket 5, which is made by bending a plate, is deformed by being pressed between a bearing surface 55 of the flange 54 and an opening edge 205 of the screw hole 201. As the gasket 5 is deformed, a gap between the spark plug 100 and the engine head 200 is sealed, and leakage of combustion gas through the screw hole 201 is suppressed.

A crimping portion 53, which is thin, is disposed on the rear side of the tool engagement portion 51 of the metallic shell 50. A buckling portion 58, which is thin, is disposed between the flange 54 and the tool engagement portion 51. Ring members 6 and 7, which have annular shapes, are interposed between a part of the inner peripheral surface of the metallic shell 50, the part extending from the tool engagement portion 51 to the crimping portion 53, and the outer peripheral surface of the rear body 18 of the insulator 10. A space between the ring members 6 and 7 is filled with talcum powder 9. In the process of manufacturing the spark plug 100, when the crimping portion 53 is bent inward and crimped, the buckling portion 58 is deformed (buckled) outward as a compressive force is applied thereto. As a result, the metallic shell 50 and the insulator 10 are fixed to each other. The talcum powder 9 is compressed in the crimping process, so that hermeticity between the metallic shell 50 and the insulator 10 is increased.

A ledge portion 57, which protrudes inward in the radial direction, is disposed on an inner periphery of the metallic shell 50. A plate packing 8, which is annular, is disposed between the ledge portion 57 of the metallic shell 50 and the outer stepped portion 16 of the insulator 10. The plate packing 8 also ensures hermeticity between the metallic shell 50 and the insulator 10 to suppress leakage of combustion gas.

The ground electrode 30, which is an electrode joined to the front end of the metallic shell 50, is preferably made of an anticorrosive alloy. The ground electrode 30 is joined to the metallic shell 50 by, for example, welding. A front end portion 33 of the ground electrode 30 faces the front end of the center electrode 20.

A high-voltage cable (not shown) is connected to the terminal nut 40 through a plug cap (not shown). As described above, when a high voltage is applied across the terminal nut 40 and the engine head 200, spark discharge occurs between the ground electrode 30 and the center electrode 20.

Figure 2A:
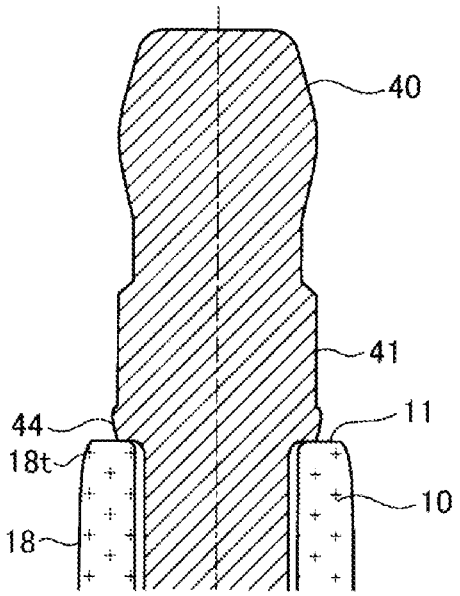
FIGS. 2(A), 2(B) and 2(C) illustrate enlarged views of a terminal nut and an insulator.
Figure 2B:
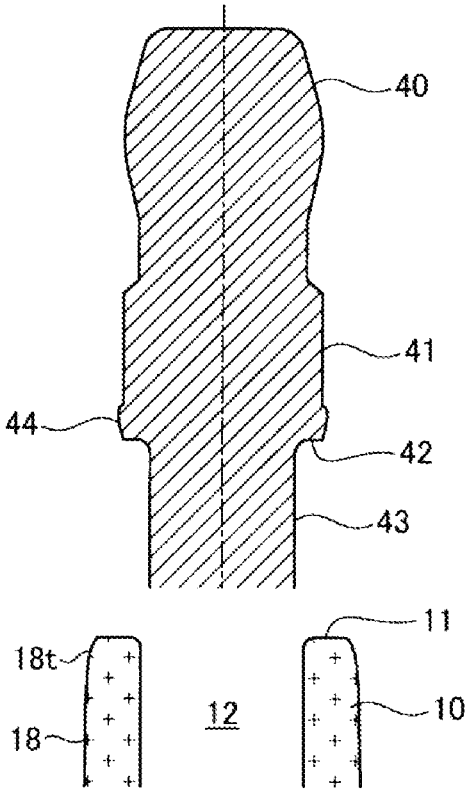

FIG. 2(A) is an enlarged view illustrating rear end portions of the terminal nut 40 and the insulator 10. FIG. 2(B) illustrates the terminal nut 40 and the insulator 10, which are separated from each other. As described above with reference to FIG. 1, the insulator 10 includes the rear body 18, the rear-end tapered portion 18*t*, and the flat portion 11. The terminal nut 40 includes a small diameter portion 43 in a front portion thereof; a large diameter portion 41 in a rear portion thereof; and a stepped portion, which has a contact surface 42, between these portions 43 and 41. The contact surface 42 of the terminal nut 40 is in surface-contact with the flat portion 11 of the insulator 10. A projecting portion 44, in which the outside diameter gradually increases toward the rear side and then gradually decreases, is disposed in a rear end portion of the terminal nut 40 adjacent to the contact surface 42. The projecting portion 44 may be also referred to as a "flange." The inside diameter of the axial hole 12 of the insulator 10 is slightly larger than the outside diameter of the small diameter portion 43 of the terminal nut 40 so that the terminal nut 40 can be inserted into the axial hole 12 of the insulator 10.

Figure 2C:
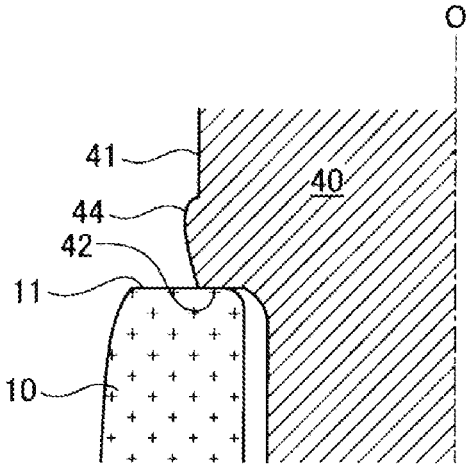

FIG. 2(C) is an enlarged view illustrating a region surrounding the flat portion 11, which is located at the rear end of the insulator 10. The insulator 10 and the terminal nut 40 are in surface-contact with each other in an annular region between the outside diameter of the contact surface 42 of the terminal nut 40 and the inside diameter of the flat portion 11 of the insulator 10.

Figure 3A:
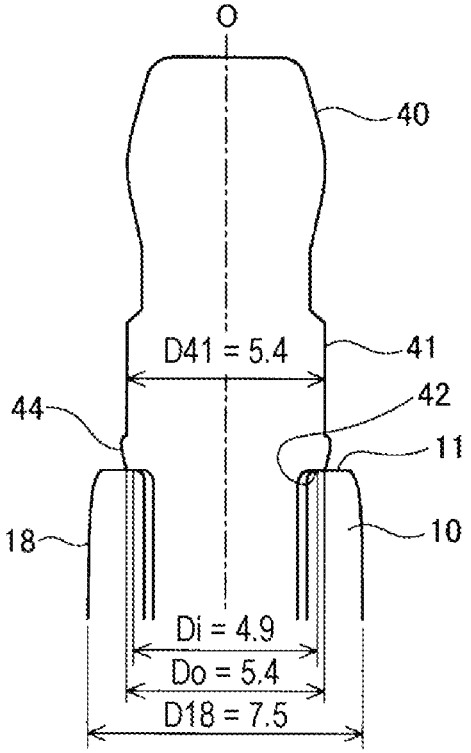
FIGS. 3(A), 3(B) and 3(C) illustrate the dimensions of a sample S03 having the shape shown in FIGS. 2(A)-2(C).
Figure 3B:
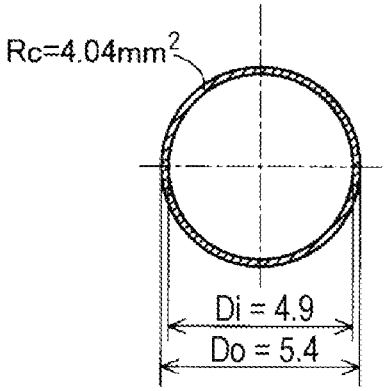
Figure 3C:
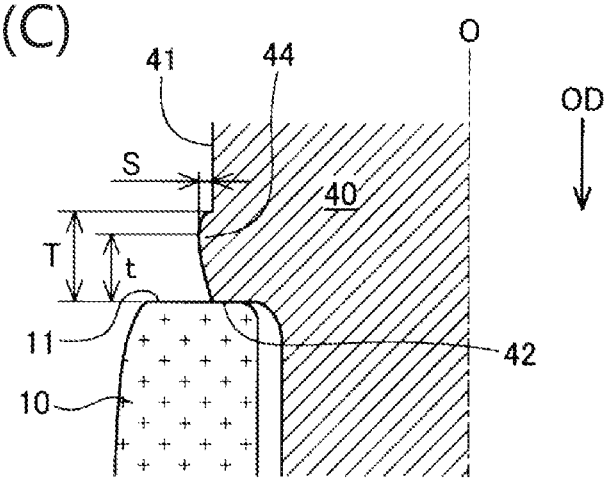

FIGS. 3(A)-3(C) illustrate the dimensions of a sample S03 having the shape shown in FIGS. 2(A)-2(C). In FIG. 3(A), hatching is omitted for convenience of illustration. In the sample S03, the outside diameter D41 of the large diameter portion 41 of the terminal nut 40 is 5.4 mm, and the outside diameter D18 of the rear body 18 of the insulator 10 is 7.5 mm. The outside diameter Do of the contact surface 42 of the terminal nut 40 is 5.4 mm, and the inside diameter Di of the flat portion 11 of the insulator 10 is 4.9 mm. As illustrated in FIG. 3(B), the area Rc of a region in which the insulator 10 and the terminal nut 40 are in surface-contact with each other is the difference between the area of a circle having a diameter equal to the outside diameter Do of the contact surface 42 of the terminal nut 40 and the area of a circle having a diameter equal to the inside diameter Di of the flat portion 11 of the insulator 10. In this example, the contact area Rc is 4.04 $mm^2$.

FIG. 3(C) illustrates dimensions related to the projecting portion 44. The projecting portion 44 is adjacent to the rear end of the contact surface 42 of the terminal nut 40. In the projecting portion 44, the outside diameter of the terminal nut 40 gradually increases toward the rear side in the axial direction OD and then gradually decreases after reaching its peak. The difference S (hereinafter, referred to as the "clearance S") between the maximum outside diameter of the large diameter portion 41 and the outside diameter of the projecting portion 44 at the rear end thereof (that is, the outside diameter D41 of the large diameter portion 41) is an indicator of the magnitude of the maximum outside diameter of the projecting portion 44. When the clearance S of the projecting portion 44 is large, surface creepage (flashover) from the position of the maximum outside diameter of the projecting portion 44 toward the metallic shell 50 (FIG. 1) is likely to occur. Therefore, preferably, the clearance S of the projecting portion 44 is small.

The width T of the projecting portion 44 in the axial direction OD corresponds to the distance between the lower end and the upper end of the projecting portion 44. The distance t from the flat portion 11 of the insulator 10 to the position of the maximum outside diameter of the projecting portion 44 of the terminal nut 40 corresponds to the distance from the lower end of the projecting portion 44 to the position of the maximum outside diameter. When the ratio t/(T/2) of the distance t to a half (T/2) of the width T of the projecting portion 44 is 1, the position of the maximum outside diameter of the projecting portion 44 is at the center of the width T of the projecting portion 44. The farther the position of the maximum outside diameter of the projecting portion 44 from the insulator 10, the more unlikely flashover occurs. Therefore, preferably, the ratio t/(T/2) is as large as possible. The results of an experiment concerning the parameters t and T, which are related to the shape of the projecting portion 44, will be described below.

Figure 4A:
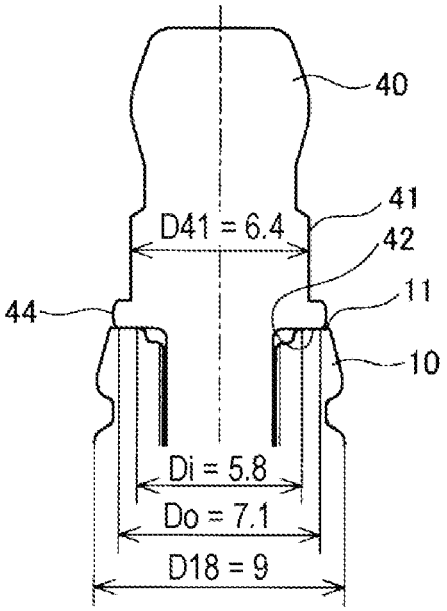
FIGS. 4(A) and 4(B) illustrate the shape and the dimensions of a sample C01 of a first comparative example.
Figure 4B:
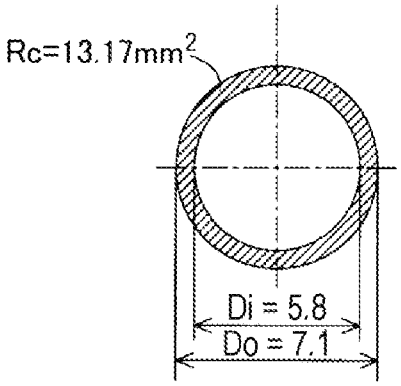

FIGS. 4(A) and 4(B) illustrate the shape and the dimensions of a sample C01 as a first comparative example. In the sample C01, the area of the contact surface 42 of the terminal nut 40 is increased by forming the projecting portion 44 of the terminal nut 40 so as to have a flange-like shape. The outside diameter D41 of the large diameter portion 41 of the terminal nut 40 is 6.4 mm, and the outside diameter D18 of the rear body 18 of the insulator 10 is 9.0 mm. The outside diameter Do of the contact surface 42 of the terminal nut 40 is 7.1 mm, and the inside diameter Di of the flat portion 11 of the insulator 10 is 5.8 mm. The contact area Rc between the insulator 10 and the terminal nut 40 is 13.17 $mm^2$. The sample C01 differs from the sample S03 of FIGS. 3(A)-3(C) in that the insulator 10 has corrugations.

Figure 5A:
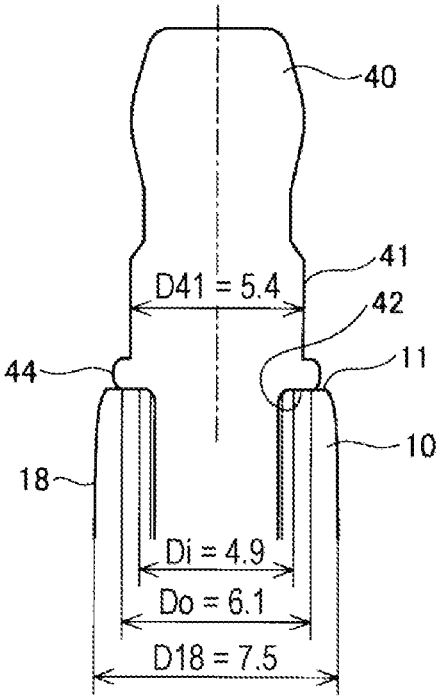
FIGS. 5(A) and 5(B) illustrate the shape and the dimensions of a sample C02 of a second comparative example.
Figure 5B:
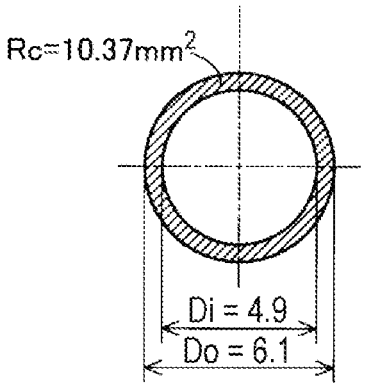

FIGS. 5(A) and 5(B) illustrate the shape and the dimensions of a sample C02 as a second comparative example. In the sample C02, as in the sample C01, the projecting portion 44 of the terminal nut 40 has a flange-like shape. However, the size of the projecting portion 44 of the sample C02 is smaller than that of the sample C01 and larger than that of the sample S03 of FIGS. 3(A)-3(C). In the sample C02, the outside diameter D41 of the large diameter portion 41 of the terminal nut 40 is 5.4 mm, and the outside diameter D18 of the rear body 18 of the insulator 10 is 7.5 mm. The outside diameter Do of the contact surface 42 of the terminal nut 40 is 6.1 mm, and the inside diameter Di of the flat portion 11 of the insulator 10 is 4.9 mm. The contact area Rc between the insulator 10 and the terminal nut 40 is 10.37 $mm^2$. As can be understood by comparing FIGS. 5(A) and 5(B) with FIGS. 3(A)-3(C), the shape and the dimensions of the insulator 10 of the sample C02 of FIGS. 5(A) and 5(B) are the same as those of the sample S03 of FIGS. 3(A)-3(C), and only the shape and the dimensions of the terminal nut 40 of the sample C02 differ from those of the sample S03. The largest difference between the sample C02 of FIGS. 5(A) and 5(B) and the sample S03 of FIGS. 3(A)-3(C) is the value of the outside diameter Do of the contact surface 42 of the terminal nut 40. Moreover, in accordance with the value of the outside diameter Do of the contact surface 42, the value of the contact area Rc between the insulator 10 and the terminal nut 40 considerably differs from that of the sample S03. The sample C02 is the same as the sample S03 of FIGS. 3(A)-3(C) in that the rear body 18 of the insulator 10 does not have corrugations.

Figures 6, 7:
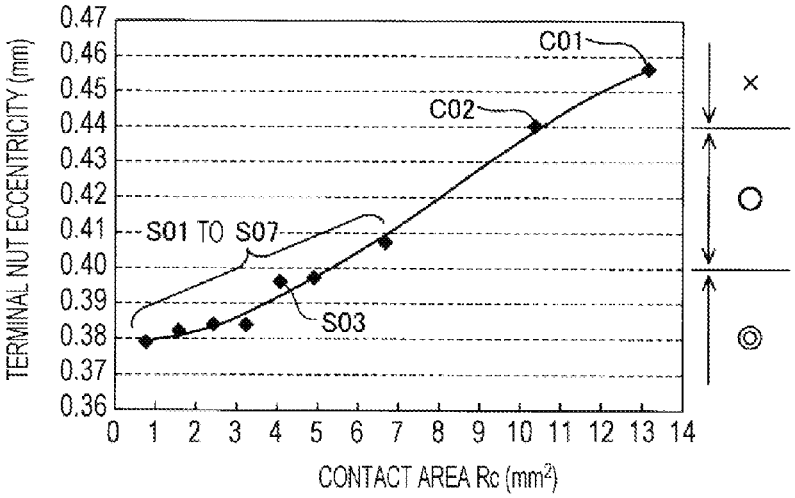
FIG. 6 shows the dimensions of various samples and experimental results related to the mechanical characteristics of the samples.
FIG. 7 is a graph representing the relationship between the contact area Rc and the terminal nut eccentricity of the samples.

FIG. 6 shows the dimensions of various samples and experimental results related to the mechanical characteristics of the samples. The samples C01, C02, and S03 are samples described above with reference to FIGS. 4(A) and 4(B), 5(A) and 5(B), and 3(A)-3(C), respectively. Besides these samples, sample S01, S02, and S04 to S07 are added to the table of FIG. 6. Except for the outside diameter Do of the contact surface 42 and the contact area Rc, the dimensions of the additional samples S01, S02, and S04 to S07 are the same as those of the sample S03. In the samples S01 to S07, the contact area Rc between the insulator 10 and the terminal nut 40 gradually decreases from 6.66 $mm^2$ to 0.78 $mm^2$ in accordance with the outside diameter Do of the contact surface 42. In other words, the samples S01 to S07 are samples in which the value of the contact area Rc between the insulator 10 and the terminal nut 40 is changed by setting the outside diameter Do of the contact surface 42 at different values. The sample C02 as the second comparative example is also a sample in which the contact area Rc between the insulator 10 and the terminal nut 40 is increased from that of sample S03 by increasing the outside diameter Do of the contact surface 42.

The terminal nut eccentricity shown in the second column from the right end of FIG. 6 represents an experimental result of measuring the eccentricity between the terminal nut 40 and the insulator 10 after the terminal nut 40 was fixed to the insulator 10 by a heat sealing process. Each of the values of terminal nut eccentricity is the sum of the average of the values of the eccentricity measured for thirty test pieces, which were fabricated for each of the samples, and three times the standard deviation (3σ) of the eccentricity. 3σ was added in order to obtain a value corresponding to the maximum value of actual eccentricity. When the terminal nut eccentricity is large, it is highly likely that the actual eccentricity between the terminal nut 40 and the insulator 10 after the heat sealing process is large. Accordingly, as described in "Background Art," in the crimping process of crimping the metallic shell, a necessary assembly accuracy may not be satisfied and flashover may become more likely to occur.

Among the samples C01, C02, and S01 to S07 shown in FIG. 6, the outside diameter D18 of the rear body 18 of the insulator 10 is 9.0 mm in the sample C01, and the outside diameter D18 is 7.5 mm in all of other samples C02 and S01 to S07. In the case where the outside diameter D18 of the rear body 18 of the insulator 10 is larger than or equal to 8 mm, the distance between the outer periphery of the flat portion 11 and the outer periphery of the projecting portion 44 can be made comparatively large, so that flashover is not likely to occur and the effect of the eccentricity on flashover does not tend to cause a problem. In this sense, in the case where the outside diameter D18 of the rear body 18 of the insulator 10 is smaller than or equal to 8 mm, a more significant advantage can be obtained by reducing the eccentricity between the terminal nut 40 and the insulator 10.

FIG. 7 is a graph representing the relationship between the contact area Rc and the terminal nut eccentricity of the samples C01, C02, and S01 to S07 of FIG. 6. The samples C01 and C02 of the comparative examples are not preferable, because the terminal nut eccentricity has large values, which are larger than or equal to 0.44 mm. The samples S01 to S07 are preferable, because the terminal nut eccentricity has comparatively small values, which are smaller than or equal to 0.43 mm. In particular, in consideration of an assembly accuracy in assembly processes of a spark plug, such as the crimping process of crimping the metallic shell, the value of the terminal nut eccentricity is preferably smaller than 0.42 mm, more preferably smaller than 0.41 mm, and most preferably smaller than 0.40 mm. In this respect, the value of the contact area Rc between the flat portion 11 of the insulator 10 and the contact surface 42 of the terminal nut 40 is preferably smaller than 8 $mm^2$, more preferably smaller than 7 $mm^2$ (or smaller than or equal to 6.7 $mm^2$), and most preferably smaller than 5 $mm^2$ (or smaller than or equal to 4.9 $mm^2$).

"Presence/Absence of Insulator Crack" shown at the right end of FIG. 6 represents an experimental result of examining whether a crack occurred in a head (back end portion) of the insulator 10 after the terminal nut 40 was fixed to the insulator 10 by the heat sealing process. In this column, a blank circle "O" represents a sample in which an insulator crack did not occur at all, and a blank triangle "Δ" represents a sample in which an insulator crack occurred in some of the test pieces. When the outside diameter Do of the contact surface 42 is reduced in order to reduce the contact area Rc, the thickness of the rear end portion of the insulator 10 decreases, and therefore an insulator crack tends to occur. Regarding the occurrence of an insulator crack, all of the samples S01 to S07 are in a practical range. In order to maximally suppress occurrence of an insulator crack, the value of the contact area Rc is preferably larger than or equal to 1.0 $mm^2$ and more preferably larger than or equal to 2.3 $mm^2$. It is estimated that the experimental results related to the samples C02 and S01 to S07 in FIG. 6 are the same those in a case where the inside diameter Di of the flat portion 11 is changed, instead of changing the outside diameter Do of the contact surface 42.

Figure 8:
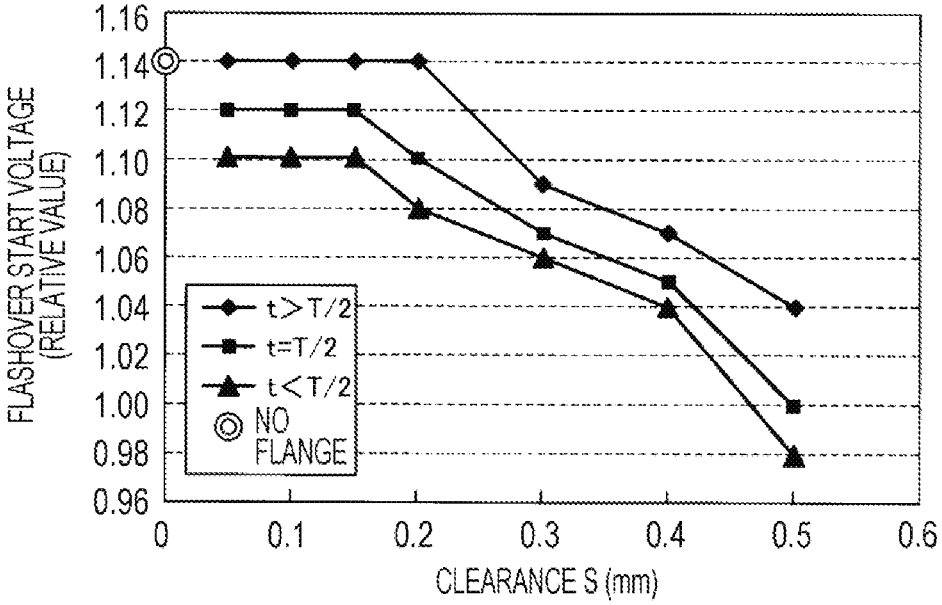
FIG. 8 is a graph representing the relationship among the clearance S of a projecting portion of the terminal nut, the width T of the projecting portion, and the flashover start voltage.

FIG. 8 is a graph representing the relationship among the clearance S between the projecting portion 44 of the terminal nut 40 (FIG. 3(C)), the width T of the projecting portion 44, and the flashover start voltage. In the figure, the horizontal axis represents the clearance S of the projecting portion 44 of the terminal nut 40, and the vertical axis represents the relative value of the flashover start voltage. This figure shows three graphs for three cases between which the size relationship between the distance t (FIG. 3(C)) from the flat portion 11 of the insulator 10 to the position of the maximum outside diameter of the projecting portion 44 of the terminal nut 40 and a half (T/2) of the width T of the projecting portion 44 differs from each other. In the three cases, the values of the distance t and the width T are as follows.

(1) a case where t>T/2: t=0.75 mm, T=1.0 mm (2) a case where t=T/2: t=0.50 mm, T=1.0 mm (3) a case where t<T/2: t=0.25 mm, T=1.0 mm The relative value of the flashover start voltage is a relative value with reference to the case where t=T/2 and the clearance S=0.5 mm. FIG. 8 also illustrates the flashover start voltage in the case of "no flange." The term "no flange" means that the projecting portion 44 is completely removed from the sample S03 shown in FIGS. 3(A)-3(C) so as to form a cylindrical shape. The shapes and the dimensions of test pieces used in the experiment of FIG. 8 are the same as those of the sample S03 of FIGS. 3(A)-3(C), except for the parameter S, t, and T.

As can be understood from FIG. 8, in order to suppress occurrence of flashover, preferably, the clearance S of the projecting portion 44 is small. This is because, when the clearance S of the projecting portion 44 is large, surface creepage (flashover) from the position of the maximum outside diameter of the projecting portion 44 toward the metallic shell 50 (FIG. 1) is likely to occur. In this respect, the clearance S of the projecting portion 44 is preferably smaller than 0.3 mm, more preferably smaller than or equal to 0.2 mm, and most preferably smaller than or equal to 0.15 mm.

Preferably, the ratio t/(T/2) of the distance t to a half (T/2) of the width T of the projecting portion 44 is large. This is because, as the value of the ratio t/(T/2) exceeds 1 by a larger amount, the position of the maximum outside diameter of the projecting portion 44 becomes farther from the insulator 10, and flashover becomes more unlikely to occur. In this respect, preferably, the ratio t/(T/2) of the distance t to a half (T/2) of the width T of the projecting portion 44 is larger than 1 (that is, t>(T/2)). "no flange," which corresponds to a case where there is no projecting portion 44, is also preferable, because the flashover start voltage is high.

It can be understood from the entirety of FIG. 8 that, preferably, the clearance S of the projecting portion 44 is smaller than or equal to 0.2 mm and t>(T/2). However, it is not necessary that both of the condition on the clearance S of the projecting portion 44 and the condition t>(T/2) be satisfied, and only one of these conditions may be satisfied. It is estimated that the preferable ranges of the three parameters S, t, and T described above have similar tendencies also in a case where the parameters S, t, and T differ from those of FIG. 8.

Modifications

The present invention is not limited to the examples and embodiments described above and can be implemented in various forms within the spirit and scope thereof.

Modification 1:

As a spark plug, spark plugs having various structures other than that shown in FIG. 1 can be applied to the present invention. In particular, specific shapes of the terminal nut and the insulator can be modified in various ways.

REFERENCE SIGNS LIST

3 ceramic resistor
4 sealing member
5 gasket
6 ring member
8 plate packing
9 talc
10 insulator
11 flat portion
12 axial hole
13 first cylindrical portion
14 tapered portion
15 second cylindrical portion
16 outer stepped portion
17 front body
18 rear body
18*t* rear-end tapered portion
19 flange
20 center electrode
21 electrode base member
22 core
30 ground electrode
33 front end portion
40 terminal nut
41 large diameter portion
42 contact surface
43 small diameter portion
44 projecting portion
50 metallic shell
51 tool engagement portion
52 threaded portion
53 crimping portion
54 flange
55 bearing portion
57 ledge portion
58 buckling portion
59 threaded neck
100 spark plug
200 engine head
201 screw hole
205 opening edge Having described the invention, the following is claimed:

1. A spark plug comprising:

an insulator including an axial hole extending in an axial direction and a flat portion located at a rear end; a terminal nut disposed at a rear end of the axial hole and having a contact surface that is in contact with the flat portion; and a tubular metallic shell holding the insulator therein, wherein an outside diameter of the insulator at a rear end of the metallic shell is smaller than or equal to 8 mm, wherein a contact area between the flat portion of the insulator and the contact surface of the terminal nut is smaller than 10 $mm^2$, wherein the terminal nut includes a projecting portion that is adjacent to a rear end of the contact surface and in which an outside diameter of the terminal nut gradually increases toward a rear side in the axial direction and then gradually decreases, and wherein a difference between a maximum outside diameter of the projecting portion and the outside diameter of the terminal nut at a rear end of the projecting portion is smaller than or equal to 0.2 mm.

2. The spark plug according to claim 1, wherein the contact area is smaller than 8 $mm^2$.

3. The spark plug according to claim 2, wherein the contact area is smaller than 5 $mm^2$.

4. The spark plug according to claim 1, wherein the contact area is larger than or equal to 2.3 $mm^2$.

5. The spark plug according to claim 1, wherein a distance t, measured in the axial direction, from the flat portion of the insulator to a position of the maximum outside diameter of the projecting portion of the terminal nut and a width T of the projecting portion in the axial direction have a relationship $t>T/2$.

6. The spark plug according to claim 1, wherein an outer shape of the insulator on a rear side of the rear end of the metallic shell includes a columnar portion and a rear-end tapered portion, the columnar portion being adjacent to the rear end of the metallic shell and having a uniform outside diameter, the rear-end tapered portion being adjacent to a rear end of the columnar portion and having an outside diameter that gradually decreases to the flat portion.

* * * * *